United States Patent [19]

Dimur

[11] Patent Number: 4,766,715

[45] Date of Patent: Aug. 30, 1988

[54] ENVELOPE OPENING DEVICE

[75] Inventor: Gérard Dimur, Epinay sur Orge, France

[73] Assignee: SMH Alcatel, Paris, France

[21] Appl. No.: 53,891

[22] Filed: May 26, 1987

[30] Foreign Application Priority Data

May 26, 1986 [FR] France ..... 86 07472

[51] Int. Cl.[4] ..... B65H 47/00

[52] U.S. Cl. ..... 53/381 R; 53/266 A

[58] Field of Search ..... 53/266 A, 381 R, 382, 53/384, 492, 206; 493/245

[56] References Cited

U.S. PATENT DOCUMENTS

| | | | |
|---|---|---|---|
| 2,019,211 | 10/1935 | Clare | 53/266 A X |
| 2,114,814 | 4/1938 | Rosebush | 53/266 A X |
| 2,668,053 | 2/1954 | Bach . | |
| 2,766,569 | 10/1956 | Strother et al. | 53/266 A X |
| 2,915,863 | 12/1959 | Kummer | 53/384 X |
| 3,797,196 | 3/1974 | Harbison | 53/384 X |

FOREIGN PATENT DOCUMENTS 1561881 4/1970 Fed. Rep. of Germany .

*Primary Examiner*—James F. Coan
*Assistant Examiner*—Steven P. Weihrouch
*Attorney, Agent, or Firm*—Sughrue, Mion, Zinn, Macpeak, and Seas

[57] ABSTRACT

The envelope opening device comprises a substantially horizontal chute (1) receiving envelopes separate from one another, with the top edges of the envelopes running along the bottom of the chute, an extraction roll (35) mounted above the chute substantially level with the bottom edges of envelopes present in the chute, an associated roll (36) mounted facing the extraction roll on a pivot arm (37) controlled to apply pressure against the extraction roll or to move away therefrom, and a blade (42) mounted beneath the extraction roll and having one end extending beyond a pressure zone defined by the rolls. This device is used in mail processing machines.

8 Claims, 3 Drawing Sheets

ENVELOPE OPENING DEVICE

The present invention relates to automatic or semiautomatic machines for processing mail. It relates to devices for opening envelopes which are received separate from one another and having their non-stuck flaps folded against the bodies of the envelopes.

BACKGROUND OF THE INVENTION

In mail processing machines, such devices are used, in particular, for manual or automatic envelope stuffing. They can also be used for detecting that envelopes have indeed been stuffed prior to closure and franking, or that the flaps of stuffed envelopes have been unfolded prior to dampening the gummed portions of the flaps for closure purposes.

In mail processing machines, envelopes are taken one by one from a magazine in which they are stacked with their flaps folded against their bodies. The envelopes are taken by an unstacking machine which applies them to a conveyor at its outlet, with the envelopes being presented separate from one another and being delivered to a processing station, for example a station where the envelopes are opened for subsequent stuffing.

The presentation of open envelopes assists an operator if the envelopes are being stuffed manually, and is essential in mail processing machines that perform stuffing automatically.

French patent publication No. 1 584 973 describes a transporter device for envelopes, for the purposes of automating the separating, the opening, the stuffing, the dampening, and the closing of envelopes. In particular, elements are provided on the path of envelopes coming separate from one another from a magazine in order to open the flaps of said envelopes.

These elements are constituted by two pairs of rolls which are disposed one after the other so that each envelope arriving base foremost is engaged at a given moment between said two pairs of rolls, and a hinged lever then applies a considerable curve to the envelope held between the pairs of rolls in order to separate the flap from the body of the envelope. This envelope curvature is assisted by the downstream pair of rolls on the envelope path giving the envelope a lower speed than that given by the upstream pair of rolls. A blade disposed upstream from the downstream pair of rolls holds the flap so as to open the envelope fully.

In such devices where the top edge of the envelope (i.e. the edge with the flap attached thereto) is situated on the rear of the envelope path, there are problems of reliability in operation related to the risks of envelopes jamming or being damaged by virtue of their flaps hanging ajar prior to the envelopes being deliberately curved in order to enable the flaps to be held by the blade.

The aim of the present invention is to provide a very highly reliable device for opening envelopes at a high rate matching an envelope-stuffing rate, said device, in addition, being compact and easily integrated in mail processing machines regardless of the type of envelope unstacker that may be used.

SUMMARY OF THE INVENTION

The present invention provides a device for opening envelopes received from a conveyor and separate from one another with their flaps folded down over the bodies of the envelopes, the device comprising first means for driving the envelopes and for simultaneously curving them in order to start opening their flaps, together with an associated blade for retaining the flap of each envelope, the device being comprising the improvement of a substantially horizontal chute coupling said conveyor and said first means disposed for receiving said envelopes from said conveyor with the top edges of said envelopes coming along the bottom of the chute, and for positioning the bottom edges of each envelope level with said first means, and wherein said first means comprise said blade associated with a first pair of rolls mounted above the chute and constituted on one side of the chute by an extraction drive first roll whose periphery projects partially into the envelope path defined by said chute and against which the envelope present in the chute rests freely, and on the other side by an associated second roll carried by a first pivot arm controlled by actuator means to move between an extraction position in which said second roll presses against said first roll, and a rest position in which it is at a distance from said first roll, said blade being mounted beneath the first means and having one end inserted partially into the envelope path and extending substantially beyond the pressure zone between the first and second rolls.

Preferably, said chute has an extraction portion substantially beneath said first pair of rolls and an upstream portion for separate envelope inlet, said upstream portion being equipped on one side by a second pair of rolls constituted by a driving third roll for transferring an envelope towards said extraction portion and having its periphery projecting partially into the envelope path as defined by the chute, and by a fourth roll associated with the third roll and mounted on a second pivot arm controllable between a transfer position in which said fourth roll is pressed against the third roll, and a rest position in which said fourth roll is at a distance from said third roll.

Advantageously, an additional pair of rolls downstream from the second pair of rolls serves to transfer each envelope into said extraction portion and comprises a fifth transfer roll together with its associated pressure counter-roll mounted on an arm whose end acting as a deflector flap is inserted into the extraction portion beyond the pressure zone between said rolls.

BRIEF DESCRIPTION OF THE DRAWINGS

An embodiment of the invention is described by way of example with reference to the accompanying drawings, in which.

MORE DETAILED DESCRIPTION

Figure 1:
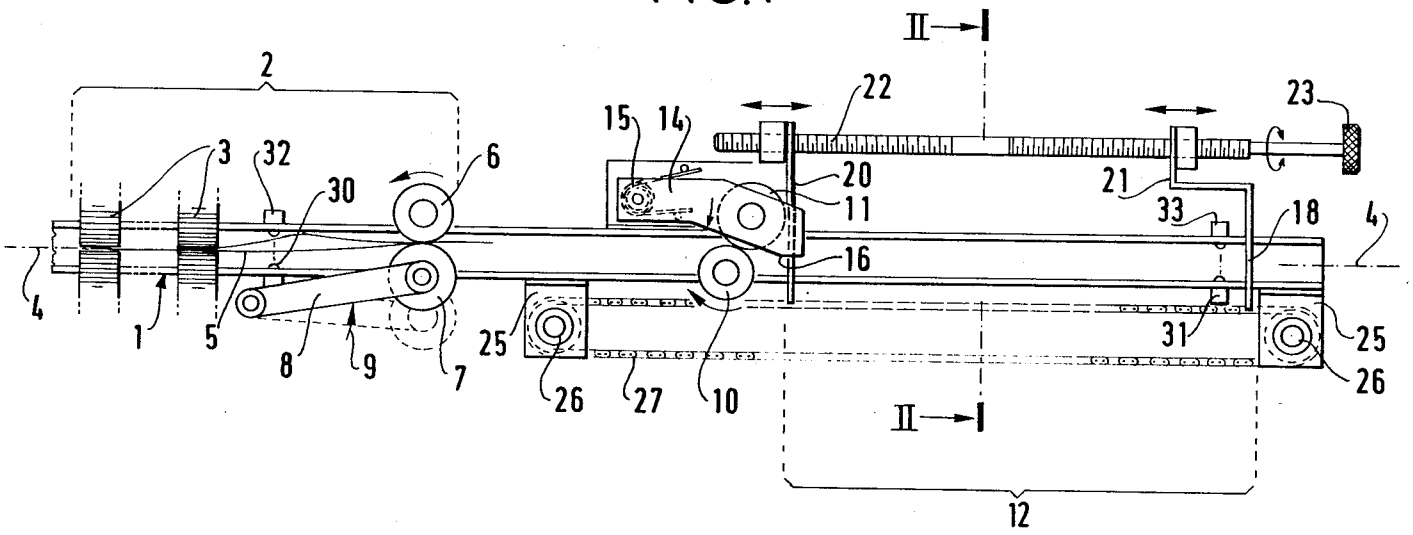
FIG. 1 is a fragmentary diagrammatic plan view of an envelope opening device in accordance with the invention.

With reference to FIG. 1, it can be seen that the device has a substantially horizontal U-shaped chute 1 running along the length thereof. At one of its end portions, referred to as the inlet portion 2, the chute 1 receives envelopes to be opened, which envelopes are separate from one another. The envelopes received in the inlet portion have their top edges running along the bottom of the chute. They are delivered to arrive in the inlet portion 2 in this position by a conveyor 3 of the type comprising pairs of facing belts mounted upwardly relative to the chute and passing through appropriate nonreferenced windows in the inlet portion 2 of the chute. The envelopes are delivered by the conveyor 3 into the envelope path defined by the chute, substantially in the mid-plane of said path (i.e. the longitudinal mid-plane of the chute) as shown by a dot-dashed line 4. Reference 5 designates an envelope present in the inlet portion 2.

In practice, in an automatic mail processing machine, said conveyor 3 is coupled to the outlet from an envelope unstacking device (not shown) which may be of any conventional type, and which may constitute the outlet conveyor from said unstacking device. The conveyor 3 applies such changes in direction as may necessary, if any, to the envelopes taken one after the other, in order to ensure that the envelopes are delivered in a vertical position with their top edges being placed on the bottom of the inlet portion of the chute.

A first pair of rolls 6 and 7 located at the inside end (relative to the chute) of the inlet portion 2 serves to transfer envelopes received in the inlet portion. These rolls are mounted slightly above the chute.

The roll 6 is a drive roll and is disposed on a first side of the chute with the periphery of the roll projecting partially into the vertical path of the envelopes as defined by the chute 1, but not quite reaching the mid-plane of the chute.

The roll 7 constitutes a counter-roll associated with the roll 6. It is mounted facing the roll 6 on the other side of the chute and is carried at the moving end of a pivot arm 8. This arm 8 is urged between two positions along the direction of arrow 9 by an electromagnet (not shown). In one of these positions taken up by the arm 8, its terminal roll 7 (shown in dashed lines) lies outside the envelope path, i.e. it is at a distance from the roll 6 and leaves the inlet portion of the chute free to receive an envelope. In the other position of the arm 8, the roll 7 (as shown by continuous lines) is pressed against the roll 6. An envelope present in the inlet portion thus has its side edge nipped between these rolls and it is driven out from the inlet portion 2.

Downstream from rolls 6 and 7, a second pair of rolls 10 and 11 take charge of each envelope as it is removed from the inlet portion in order to drive it to the opposite end portion of the chute, referred to as the extraction portion 12. These two rolls 10 and 11 are likewise slightly above the chute and at substantially the same level as the rolls 6 and 7. They are at a distance from the rolls 6 and 7 which is less than the length of the smallest format envelopes which can be processed.

The roll 10 is the drive roll and it is mounted on the opposite side of the chute to that on which the other drive roll 6 is situated, i.e. it is on the second side of the chute. Its periphery projects into the envelope path, and extends beyond the mid-plane of the chute.

The roll 11 is the counter-roll associated with the roll 10. It is mounted on the first side of the chute and at a slight distance downstream along the chute from the first roll 10. It is mounted on an arm 14 which presses it resiliently against the roll 10 under the effect of a spiral spring 15 mounted on a first terminal portion of the arm outside the chute and extending towards the roll 6.

This resiliently urged arm 14 carrying the roll 11 has a second terminal portion which projects slantingly across the envelope path beyond the point of contact between the rolls 10 and 11, and projects substantially as far as the mid-plane 4 of the chute. This second terminal portion of the arm 14 constitutes a deflector flap 16 downstream from the rolls 10 and 11 for deforming the envelopes driven by the rolls and for deflecting their trajectory through the extraction portion 12.

An abutment 18 extending across the chute limits the length of the extraction portion 12 beyond the rolls 10 and 11 to substantially the same length as that of the envelopes being processed. The deflector flap 16 which deforms each envelope as it passes and which deflects its trajectory through the extraction portion, also prevents the envelope from rebounding against the abutment 18 and pushes against the trailing side edge of the envelope. The envelope is thus immediately held still in the extraction portion ahead of the counter-roll 11 and slightly downstream from the drive roll 10.

The extraction portion 12 of the chute is defined between the pair of rolls 10 and 11 and the abutment 18 which are adjustably mounted relative to each other with the gap therebetween being defined by the length of the envelopes being processed. To this end, the pair of rolls 10 and 11 together with the arm 14 are mounted on a first support 20, and the abutment 18 is mounted on a second support 21, with the supports 20 and 21 being interconnected by a control screw 22 having oppositely handed screwed threads in the two supports. Rotating this screw from a control head 23 at the outside end of the device causes the two supports 20 and 21 to move in opposite directions so as to adjust the length of the extraction portion of the chute while keeping its center in the same place.

The height of the chute 1 is also adjustable depending on the height of the envelopes being processed. The chute is carried on supports 25 having adjustment screws 26 passing therethrough under the inter-coupled control of a chain 27 so as to cause them to be actuated simultaneously from an accessible one of the screws.

Two cells 30 and 31 are also associated with the chute 1 in order to detect an envelope in the chute. The cell 30 is mounted on one of the sides of the chute with a facing lamp 32 on the other side, said lamp and cell being situated upstream from the rolls 6 and 7 on the inlet portion 2. The cell 31 and an associated lamp 33 are mounted facing each other in the extraction portion 12. The cell 31 causes the pivot arm 8 to be actuated when there is no envelope in the extraction portion 12 when the cell 30 indicates simultaneously that there is an envelope in the inlet portion 2, thereby pressing the terminal roll 7 on the arm 8 against the drive roll 6, and thus transferring the envelope present in the inlet portion along the chute. The cell 30 also controls the application of drive to the conveyor 3 via a clutch or other equivalent means so as to cause a new envelope to be supplied when it detects that the inlet portion is empty.

Figure 2:
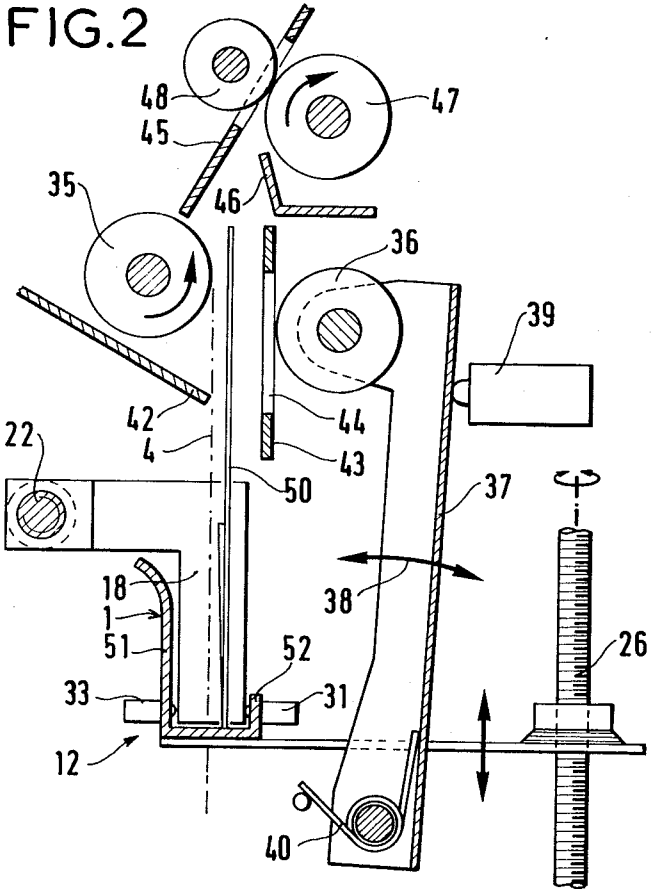
FIG. 2 is a diagrammatic section view on line II—II of FIG. 1.

FIG. 2 shows the components of the device for extracting an envelope present in the extraction portion of the chute and for opening the flap of the envelope. These components for extracting an envelope and for opening its flap comprise a pair of rolls 35 and 36 mounted on either side above the chute 1 substantially level with the bottom edge of an envelope present in the extraction portion. These rolls remain centered on the extraction portion when the length of the extraction portion is adjusted to a new value.

The roll 35 is a drive roll. It is mounted on the same side of the envelope path as are the rolls 6 and 11, i.e. on the first side of the chute. Its periphery projects part of the way into the envelope path and extends substantially up to the mid-plane 4 of the chute.

The roll 36 is the counter-roll associated therewith. It is mounted on the second side of the chute but at a slightly lower height than is the first roll. It is carried on the free end of a pivot arm 37 which is controllable between a rest position and an extraction position along an arrow 38. The arm 37 is controlled by an electromagnet 39 against a spiral return spring 40 mounted at its pivot end. In the rest position of the arm 37, the roll 36 is at a distance from the roll 35, while in the extraction position of the arm, the roll 36 is pressed against the roll 35.

A fixed blade 42 is mounted sloping towards the chute under the drive roll and projects partially into the envelope path substantially beyond the pressure zone between the rolls 35 and 36. A side flap 43 on the opposite side of the chute facing the roll 35 and the blade serves to hold an envelope in the extraction portion 12 while the roll 36 is retracted, i.e. at a distance from the roll 35. A window 44 through said flap leaves the roll 36 free to move into the envelope path when the arm 37 is actuated by the electromagnet.

Above the rolls 35 and 36, a pair of flaps 45 and 46 in an open V-configuration, together with an ejection drive roll 47 and counter-roll 48 serve to guide and take an envelope which is delivered thereto by the rolls 35 and 36. These items constitute the outlet from the device towards a processing station, and in particular an envelope stuffing station (not shown).

With reference to FIG. 2, it can be seen that the chute 1, at least in its extraction portion 12, has sides of different heights, both of which are relatively small compared with the height of envelopes such as the envelope 50 shown. One of its edges 51 facing the folded-down flap of an envelope inserted into the chute is of substantially the same height as the flap, while the other side 52 facing the front face of the envelope constitutes a simple abutment rim for the top edge of the envelope where it rests on the bottom of the groove. The envelope 50 in the extraction portion is offset relative to the center axis 4 of the chute. It is held only very loosely in the extraction portion of the chute between the top side flap 43 on one side and the roll 35 and the blade 42 on the other side which serve to prevent it from falling to one side of the other.

The operation of the device is described below with particular reference to FIGS. 3, 4, and 5 which correspond to FIG. 2 but show different positions of an envelope 50 which was initially present in the extraction portion 12 of the chute.

Figure 3:
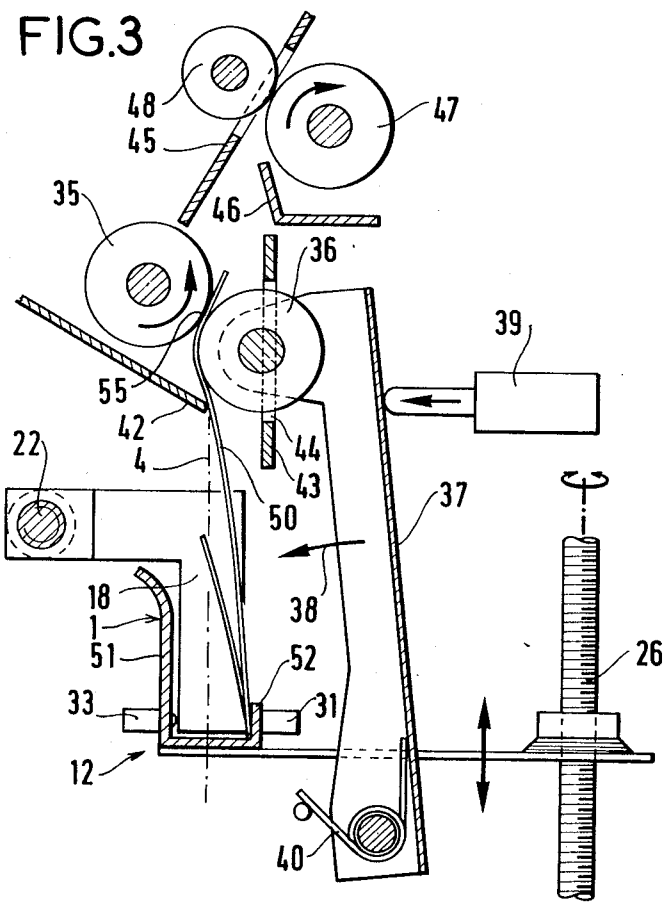
FIGS. 3, 4, and 5 are section views corresponding to FIG. 2 showing different positions of an envelope being extracted.

In FIG. 3, the electromagnet 39 has actuated the pivot arm 37 and its terminal roll 36 is pressed against the drive roll 35. These rolls nip the bottom portion of the envelope in their pressure zone 55 which is situated back from the mid-plane 4 of the chute on the same side as its larger side 51. The nipped envelope 50 is deformed by pressing against the end of the blade 42 while the top edge of the envelope comes into abutment against the side rim 52 of the chute.

The curve applied to the envelope between the rolls 35 and 36 and the end of the blade cause the flap of the envelope to fall slightly open.

Figure 4:
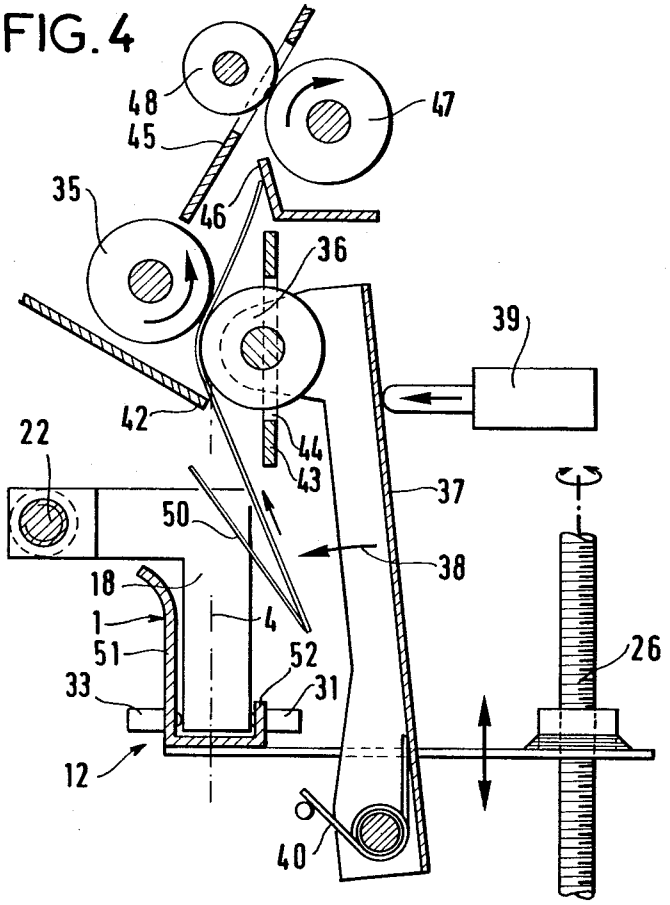

FIG. 4 shows the envelope while it is being extracted from the chute after its top edge has escaped from the rim. The propagation of the curve formed in the envelope which is no longer held by its top edge and the movement of the air due to the envelope being extracted at a high speed (about one meter per second), increases the degree to which the envelope flap is opened. As the envelope is extracted, the flap remains beneath the blade while the bottom portion of the guided envelope is directed and nipped between the outlet rolls 47 and 48.

Figure 5:
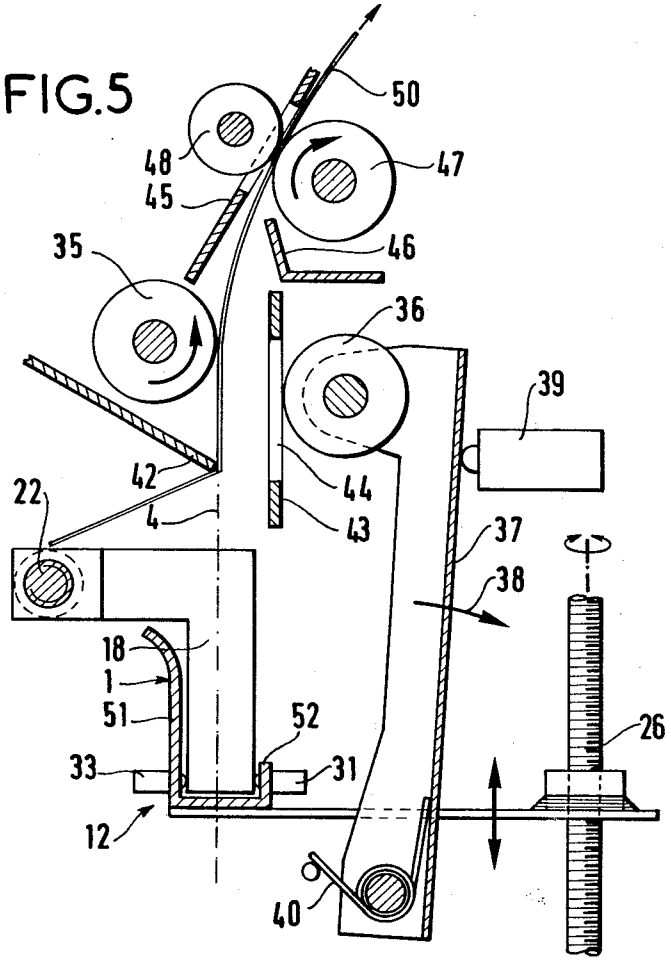

FIG. 5 shows the envelope nipped between the rolls 47 and 48 for removing it completely from the chute and in a position where the inside fold between the flap and the body of the envelope has arrived level with the end of the blade. At this moment, or slightly sooner, the electromagnet 39 releases the pivot arm 37. This arm returns to its rest position in which the roll 36 is at a distance from the roll 35 and is retracted behind the upper flap 43. The inside face of the envelope flap slides over the end of the blade as the envelope is fully extracted.

The rolls 47 and 48 deliver the envelope with its flap folded right back ready for envelope stuffing.

In a mail processing machine equipped with an envelope opening device in accordance with the invention, and providing an envelope is present in the extraction portion 12, the electromagnet 39 is actuated under the controll of a processing station situated downstream from the rolls 47 and 48 in order to deliver opened envelopes on demand to said processing station. In equivalent manner, within the envelope opening device, envelopes are successively called into the extraction portion 12 as soon as the detection cell 31 (see FIG. 1) detects that the extraction portion 1 is free and as soon as an envelope is present in the inlet portion 2. The cell 31 and its associated lamp 33 may be mounted on the edges of the chute itself and used for detecting when the top edge of the envelope is released from the chute, since the total envelope extraction time via the rolls 35, 36, and 47, 48 and the time taken to transfer an envelope from the inlet portion 1 to the extraction portion 12 of the chute compensate each other. The cell 31 and its lamp may also be mounted at a level corresponding to the blade 42 and to the roll 35.

This extraction device is easily fitted to the outlet of any unstacker, at the front thereof, or to one side. It has the advantage of fully opening the envelope flap in a highly reliable manner and over a short distance. It is compact and, in addition, it is not expensive.

The present invention has been described with reference to the example shown in the drawings. Naturally numerous detail modifications could be made thereto and various means could be replaced by other equivalent means without, thereby, going beyond the scope of the invention.

I claim:

1. In a device for opening envelopes received from a conveyor and separate from one another with their flaps folded over the bodies of the envelopes, said device comprising first means for driving the envelopes and for simultaneously curving them in order to start opening their flaps, together with an associated blade for retaining the flap of each envelope, the improvement wherein said device further comprises a substantially horizontal chute operatively positioned between said conveyor and said first means, and defining an envelope path and being disposed to receive said envelopes from said conveyor with top edges of said envelopes moving along the bottom of the chute, and for positioning bottom edges of each envelope level with said first means, and wherein said first means comprises a blade operatively positioned with a first pair of rolls mounted above the chute and constituted on one side of the chute by an extraction drive first roll whose periphery projects partially into the envelope path defined by said chute and against which the envelope present in the chute rests freely, and one the other side by an associated counter second roll carried by a first pivot arm, controlled by actuator means to move between an extraction position in which said second roll presses against said first roll, and a rest position in which it is at a distance from said first roll, said blade being mounted beneath said first pair of rolls and having one end inserted partially into the envelope path and extending laterally substantially beyond a pressure zone formed between the first and second rolls to abut said envelope to deflect said envelope between said first and second rolls and to deflect said envelope path away from said body during extraction of said envelope from said chute.

2. A device according to claim 1, wherein said chute is a U-section bar having one of its flanges, on the second roll side and at least in that portion of the chute which is substantially beneath the first pair of rolls, forming an abutment substantially for only the top edge of each envelope, said abutment serving to hold the envelope while said first pivot arm is put into the extraction position, but allowing it to escape freely substantially as soon as said envelope begins to be extracted.

3. A device according to claim 1, wherein said chute is mounted to be adjustable in height relative to said first pair of rolls.

4. A device according to claim 1, wherein said chute has an extraction chute portion substantially beneath said first pair of rolls and an upstream inlet chute portion for separate envelope inlet, said upstream portion being equipped on one side by a second pair of rolls constituted by a driving third roll for transferring an envelope towards said extraction portion and having its periphery projecting partially into the envelope path as defined by the chute, and by a fourth roll associated with the third roll and mounted on a second pivot arm controllable between a transfer position in which said fourth roll is pressed against the third roll, and a rest position in which said fourth roll is at a distance from said third roll.

5. A device according to claim 4, including a third pair of rolls mounted between said inlet portion and said extraction portion at a distance from the second pair of rolls which is less than the length of the envelopes received in the inlet portion, said third pair of rolls comprising a fifth roll for transferring envelopes towards the extraction portion and a sixth roll constituting an associated pressure counter-roll.

6. A device according to claim 5, wherein said third pair of rolls lies outside said extraction chute portion and wherein said sixth roll is coupled to a deflector flap which projects partially into said extraction chute portion beyond the pressure zone between said third pair of rolls.

7. A device according to claim 6, including an abutment serving to delimit the opposite end of said extraction chute portion distant from said third pair of rolls, said abutment being adjustably mounted with said third pair of rolls to move in the opposite direction thereto.

8. A device according to claim 4, including a first envelope detection cell in said inlet chute portion and a second envelope detection cell in said extraction chute portion, controlling said first pivot arm to cause said first pivot arm to shift to its extraction position when an envelope is present in said extraction chute portion and for causing said second pivot arm to shift to its transfer position when there is no envelope in said extraction portion and an envelope is present in the inlet chute portion.

* * * * *